US006419412B1

(12) United States Patent
Ostrowski et al.

(10) Patent No.: US 6,419,412 B1
(45) Date of Patent: Jul. 16, 2002

(54) POSITIVELY SEALED COSMETIC DISPENSER

(75) Inventors: Daniel Ostrowski, North Brunswick, NJ (US); Bruce Cummings, New York, NY (US)

(73) Assignee: Colgate Palmolive Company, New York, NY (US)

( * ) Notice: Subject to any disclaimer, the term of this patent is extended or adjusted under 35 U.S.C. 154(b) by 0 days.

(21) Appl. No.: 09/729,931

(22) Filed: Dec. 5, 2000

Related U.S. Application Data

(63) Continuation of application No. 09/665,854, filed on Sep. 20, 2000, now abandoned.

(51) Int. Cl.[7] ..... B43K 23/00

(52) U.S. Cl. ..... 401/98; 401/75; 401/68; 222/153.07

(58) Field of Search ..... 401/98, 68, 65, 401/75, 101, 116, 50, 55; D9/338; 222/153.07, 153.06, 153.01; 220/258, 270; 215/250, 254, 256

(56) References Cited

U.S. PATENT DOCUMENTS

| | | | | | |
|---|---|---|---|---|---|
| 3,981,412 | A | * | 9/1976 | Asmus | 220/270 |
| 4,529,100 | A | * | 7/1985 | Ingemann | 220/359 |
| 4,890,944 | A | * | 1/1990 | Cousins et al. | 401/98 |
| 4,950,094 | A | * | 8/1990 | Yorks | 401/75 |
| 5,020,686 | A | * | 6/1991 | Dutt | 220/276 |
| 5,511,679 | A | * | 4/1996 | Beck | 220/270 |
| D381,899 | S | * | 8/1997 | Crawford | D9/338 |
| 5,753,212 | A | * | 5/1998 | Pescatore | 424/65 |

* cited by examiner

*Primary Examiner*—Gregory Huson
*Assistant Examiner*—Huyen Le
(74) *Attorney, Agent, or Firm*—M. J. McGreal

(57) ABSTRACT

The cosmetic dispenser is comprised of a barrel that is closed at a lower end by a screw and elevator assembly and on the upper end by an integrally molded top wall. The integrally molded top wall has a weakened area at its periphery and a gripping means such as a loop whereby the top wall can be removed by severing the weakened area. The removed top wall is discarded and the screw turned to raise a portion above the sidewalls. The integrally molded top wall can be integrally molded with the barrel or it can be integrally molded to an adaptor which fits onto the top of the barrel to provide a compound curved top edge for comfort in applying the cosmetic to a skin surface. In this latter embodiment the top wall has a peripheral weakened area whereby the top wall is removed by severing this top wall at the peripheral weakened area. The structure of these embodiments provides a positively sealed and easily opened cosmetic dispenser.

19 Claims, 3 Drawing Sheets

POSITIVELY SEALED COSMETIC DISPENSER

This application is a continuation of U.S. application Ser. No. 09/665,854 filed Sep. 20, 2000, now abandoned.

FIELD OF THE INVENTION

This invention relates to a positively sealed cosmetic dispenser which has an easy opening closure. More particularly, this invention relates to a cosmetic dispenser which has a combined, low-abrasion applicator edge and an easy opening closure.

BACKGROUND OF THE INVENTION

Cosmetic dispensers such as those for antiperspirants and deodorants use several types of closures, depending to a degree on how the dispenser is filled with the product. A convenient way to fill the dispenser is the bottom fill technique where a dispenser with a cover in place is inverted and filled. This allows the upper surface of the cosmetic container's contents to be cast into a variety of shapes. It will be the shape of the inner surface of the cover. Another convenient way to fill cosmetic dispensers and to cast a top surface into a variety of shapes is by the filling of the container in an upright orientation, putting on a closure, and then to invert the container so that the top of the cosmetic then will have the shape of the closure. This also is known as the fill and flip technique.

In some dispensers there also is an adapter on the top of the barrel to transform the upper edge of the barrel from a sharp edge to a curved shape to remove a harsh scraping on the skin surface when the cosmetic is being applied. Such an adapter is described in U.S. Pat. No. 5,275,496 which is incorporated herein by reference. This type of dispenser can be bottom filled or filled by the fill and flip technique. All of these dispensers can use the present positive seal closure.

In the present invention a positive seal closure can be a part of the barrel or a part of an adapter that fits onto a barrel. It eliminates the need for a shaping closure that is needed and used only during cosmetic container filling. It is discarded by the purchaser when the dispenser is opened. It is not needed for closing the container during use. This is accomplished by the permanent overcap. The net result is a savings in material and assembly costs.

BRIEF SUMMARY OF THE INVENTION

The new dispensers have a positive seal, easy open closure that is an integral part of the upper end of the barrel of the dispenser or of an adapter that conformingly fits onto the upper end of the barrel. The closure is integrally molded with the barrel or with the adapter to the barrel and comprises a top wall which has a weakened region adjacent a sidewall of the dispenser or adapter. This weakened region is a thinned area such as a scored area at the periphery of the top wall of the closure.

The top wall also will have a gripping structure which will provide a way to peel off the top wall of the dispenser closure to expose the product in the container. The gripping structure can be any piece projecting above the top wall that can gripped. This preferably is a loop, and most preferably is mounted on the closure top wall near a peripheral edge of the top wall.

In one preferred embodiment the closure is a part of an adapter that forms a curved edge at an upper end of the barrel. The adapter fits conformingly onto an upper edge of the barrel of a dispenser. The adapter closes the barrel of the dispenser but can easily be opened by removal of the top wall via the gripping structure.

In a further preferred embodiment the closure is an integral molded part of the sidewall of the dispenser barrel forming the top wall and closing the barrel at an upper end.

The dispensers, whether the closure is an integral part of the dispenser barrel or a part of an adapter, preferably will be bottom filled. If a part of an adapter to the dispenser there is an option to top fill, put the adapter in place and invert using the fill and flip technique. However, in any mode of filling the top of the cosmetic in the dispenser will have the shape of the top wall.

DETAILED DESCRIPTION OF THE DRAWINGS

Figure 1:
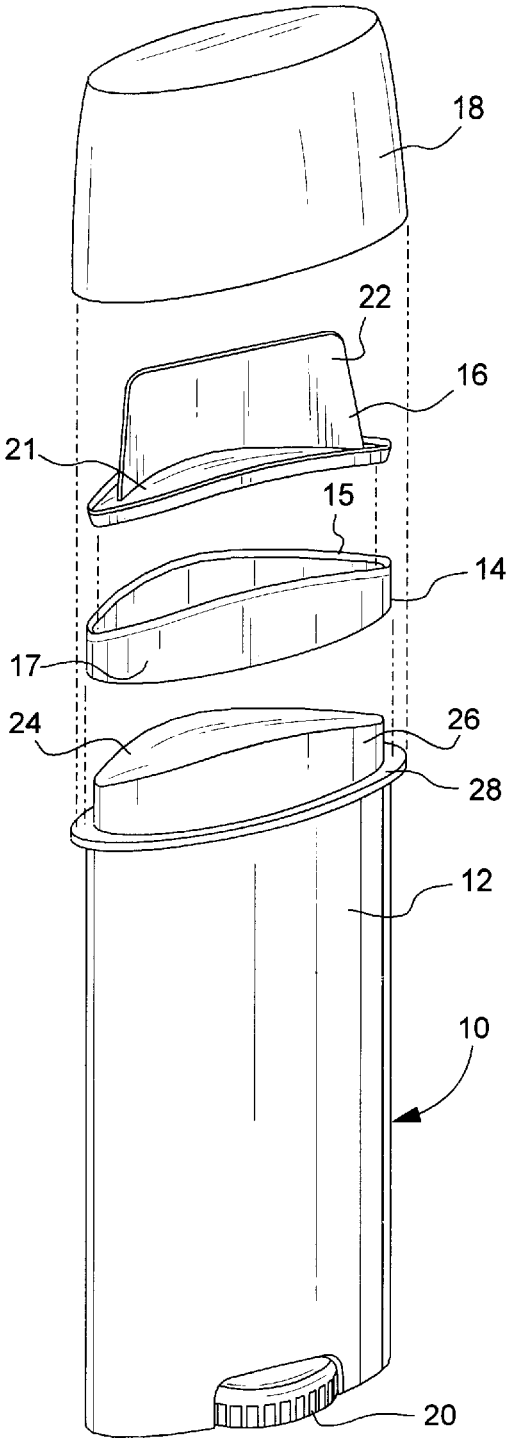
FIG. 1 is an exploded elevational view of a prior art dispenser.

The improved cosmetic dispenser will be described with reference to the drawings. A prior art dispenser is shown in FIG. 1. There is shown dispenser 10 having a barrel 12, an adapter 14, temporary closure 16 and permanent closure 18. The adapter has a curved upper edge 15 and the temporary closure has a top wall 21 and a grip 22. At the base of the barrel is screw 20 which by means of a cooperating elevator raises cosmetic 24 upwards for dispensing. The adapter 14 has a sidewall 17 which conformingly fits over wall 26 of the barrel. Flange 28 of the barrel provides a seat for both the adapter 14 and the permanent closure 18.

In the preferred assembly of the prior art dispenser the adapter is fitted down into the upper part of the barrel 12. This is latched onto the barrel. The temporary closure then is put into place onto the adapter followed by the permanent closure. The barrel then is inverted and filled with a cosmetic from the bottom and the screw 20 and attached elevator assembly snapped into place in the bottom of the barrel. The cosmetic cools and sets. The temporary closure remains with the dispenser until used. Then the permanent closure is removed, the temporary closure removed and discarded, and a portion of the cosmetic dispensed. After dispensing, the permanent closure is put into place to close the dispenser.

In a further embodiment the adapter 14 is fitted into place and the screw 20 with the attached elevator snapped into place. The barrel then is top filled with cosmetic, the temporary closure put into place followed by the permanent closure. The dispenser then is inverted while the cosmetic is flowable so that the cosmetic will have the shape of the wall 21 of the temporary closure 16. This is the fill and flip technique.

Figure 2:
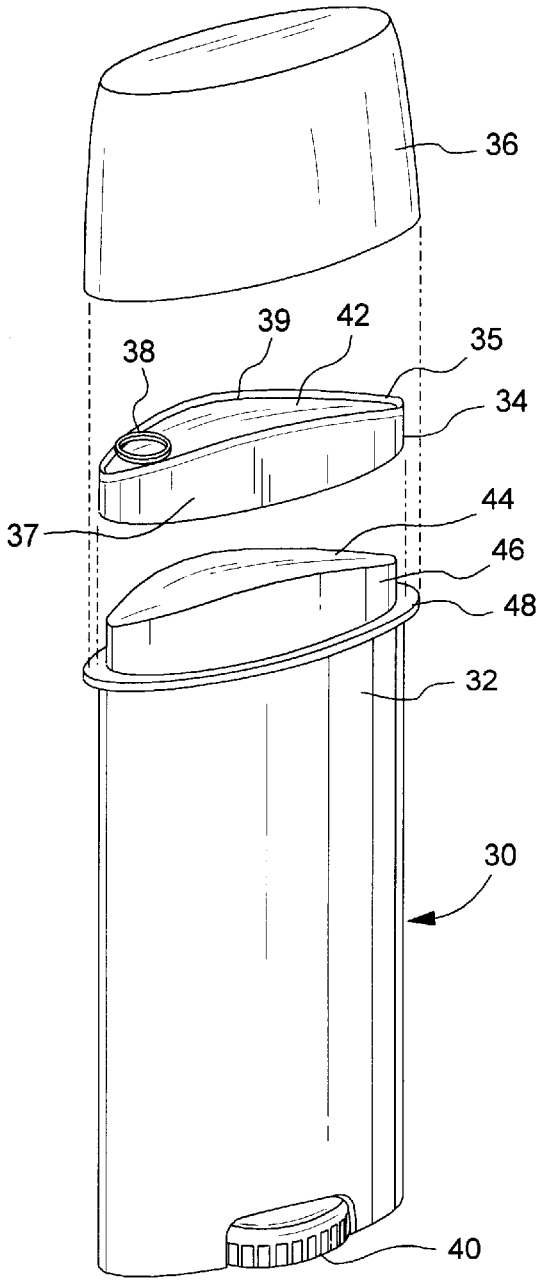
FIG. 2 is an exploded elevational view of a dispenser of the present invention.

FIG. 2 shows dispenser 30 with barrel 32, adapter 34 and permanent closure 36. The barrel has screw 40 at the base which is attached to an elevator assembly which supports the cosmetic 44. The adapter 34 has a curved edge 35, top wall 42 and sidewall 37. A grip tab 38 provides a way to remove the top wall 42 by severing the top wall 42 at a junction 39 with the sidewall 37. At this junction the top wall is thinned by a score line. The adapter conformingly fits over wall 46 and seats against flange 48. The closure 36 when in place also seats against flange 48. As with the prior art dispenser this dispenser can be bottom filled by fitting the adapter onto the barrel and optionally putting the permanent closure in place. The dispenser is inverted and bottom filled, with the cosmetic set by cooling while the dispenser is inverted. An elevator and screw assembly then is inserted. The set cosmetic will have a shape of the inner surface of the top wall of the adapter.

The dispenser also can be top filled by placing the screw and elevator assembly in the barrel, filling the barrel with the cosmetic through the top, fitting the adapter into place, optionally attaching the permanent closure, inverting the dispenser and maintaining it inverted until the cosmetic has set. In this way the cosmetic upper surface will have the shape of the inner surface of the top wall of the adapter.

Figure 3:
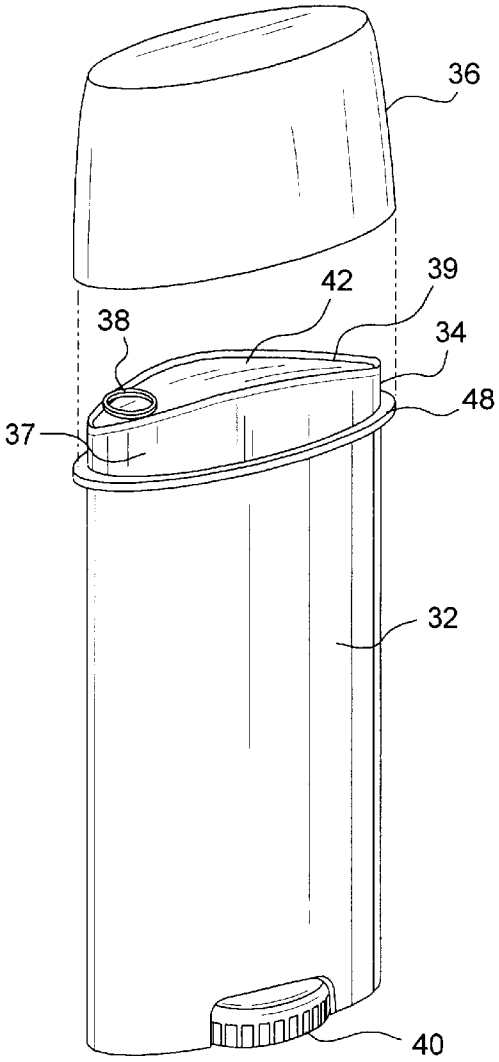
FIG. 3 is an exploded elevational view of the present dispenser with the closure in place and overcap removed.
Figure 4:
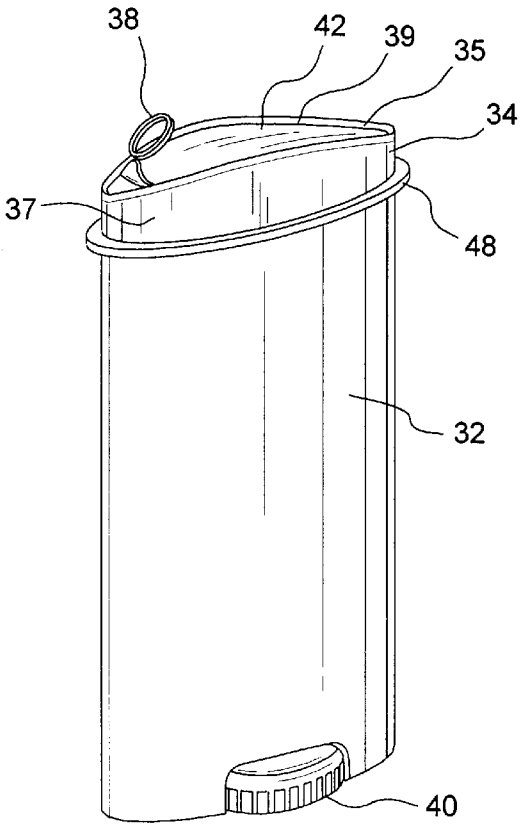
FIG. 4 is an elevational view of the dispenser of FIG. 3 with the closure top wall partially removed.
Figure 5:
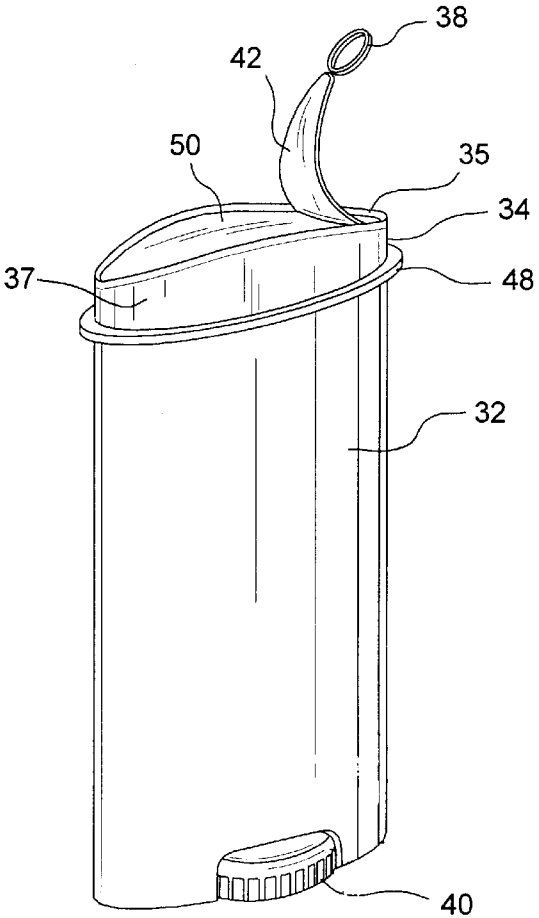
FIG. 5 is an elevational view of the dispenser of FIG. 3 with the closure mostly removed.

FIGS. 3 to 5 disclose the opening of the dispenser of FIG. 2. In FIG. 3 the permanent closure 36 is shown removed. In FIG. 4 the grip 38 is shown as raised and the top wall 42 partially removed. In FIG. 5 the top wall 42 is shown almost fully removed and the cosmetic 44 exposed. Upon full removal of top wall 42 the cosmetic dispenser is ready for use.

Figure 6:
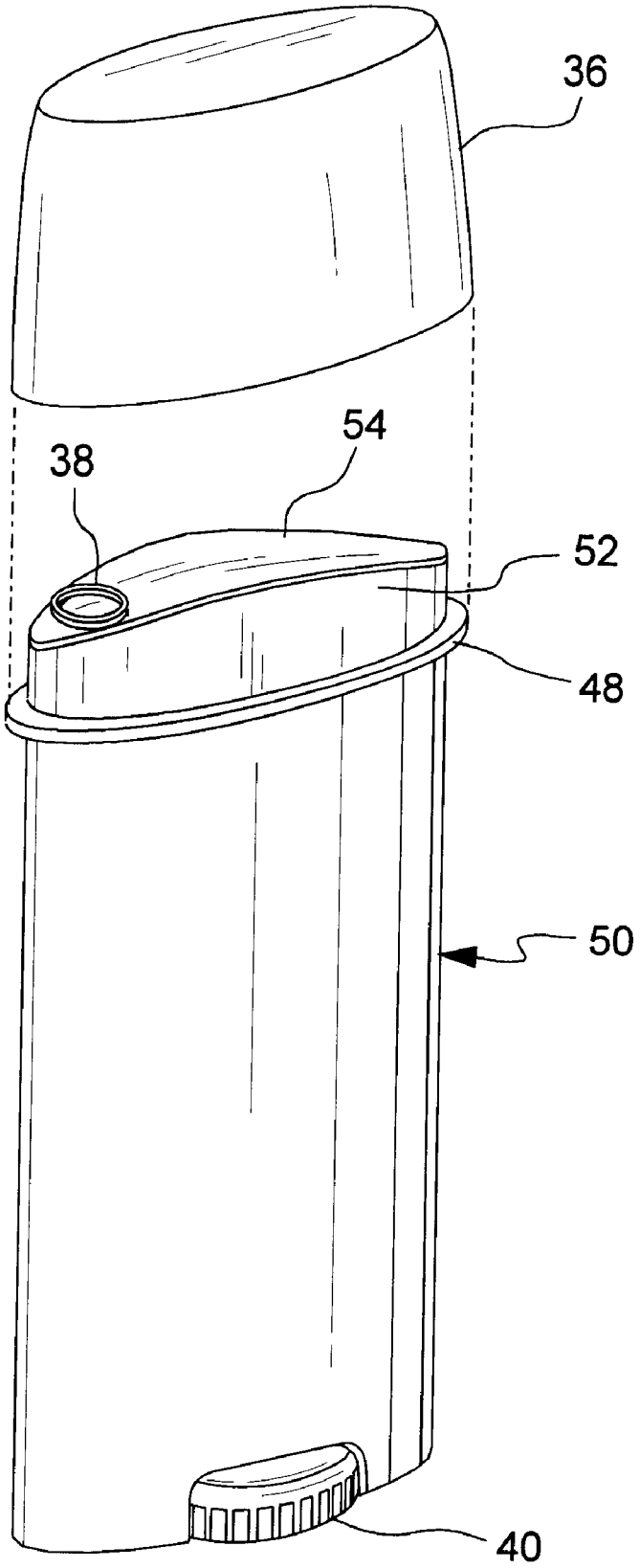
FIG. 6 is an elevational view of a dispenser where the closure is an integral part of the dispenser barrel.

FIG. 6 discloses an embodiment where the top wall 54 is an integral part of the dispenser 50. That is, it is an integrally molded to wall 52 of the barrel rather than a part of an adapter. In this embodiment the dispenser only can be bottom filled with a cosmetic.

The dispensers of this invention can be molded from any injection moldable plastic. These plastics include the polyolefins which, in turn, include polyethylene, polypropylenes, polybutadienes and mixtures of these plastics.

The preferred molding technique to be used is injection molding. These are known techniques for molding the parts for this type of a dispenser.

In the embodiment where the adapter is a separate piece from the barrel both the adapter and barrel are made separately in a single injection molding shot. However, a convenient technique to make the one piece barrel, curved edge and seal is to use a two shot injection molding technique with the barrel made in one shot and the curved edge and seal in a second shot. These are the most convenient techniques to make this dispenser.

What is claimed is:

1. A positively sealed cosmetic dispenser having a cap closure and an easy open closure comprising a barrel for containing said cosmetic, said barrel closed at one end by a screw elevator assembly and being openable at another end, said another end being closed by said cap closure and said easy open closure, said easy open closure comprising a top wall integrally connected to an upper part of a sidewall of said barrel and closing an upper end of said barrel sidewall, said top wall having a weakened region adjacent a junction with said barrel sidewall, and a gripping structure attached to said top wall for the removal of said top wall, said cap closure substantially covering said easy open closure, whereby to open said cosmetic dispenser the cap closure is removed by being pulled away from the barrel to expose said easy open closure, gripping said gripping structure and removing said top wall to expose a contained cosmetic.

2. A cosmetic dispenser as in claim 1 wherein top end of said barrel sidewall has a radius to form a convex curved top edge.

3. A cosmetic dispenser as in claim 1 wherein said easy open closure at the top edge of said barrel sidewall has a radius.

4. A cosmetic dispenser as in claim 1 wherein said weakened region is thinned region.

5. A cosmetic dispenser as in claim 1 wherein said weakened region is a score line.

6. A cosmetic dispenser as in claim 1 wherein said gripping structure is a loop.

7. A cosmetic dispenser as in claim 1 wherein said top wall is integral with said barrel sidewall and is formed integrally with said barrel sidewall.

8. A cosmetic dispenser as in claim 7 wherein top end of said barrel sidewall has a radius to form a convex curved top edge.

9. A cosmetic dispenser as in claim 7 wherein said easy open closure at the top edge of said barrel sidewall has a radius.

10. A cosmetic dispenser as in claim 7 wherein said weakened region is thinned region.

11. A cosmetic dispenser as in claim 7 wherein said weakened region is a score line.

12. A cosmetic dispenser as in claim 7 wherein said gripping structure is a loop.

13. A cosmetic dispenser as in claim 1 wherein said barrel has an overlaying sidewall at said another end, said overlaying sidewall closed by said top wall.

14. A cosmetic dispenser as in claim 13 wherein a junction of said overlaying sidewall and said top wall has a radius.

15. A cosmetic dispenser as in claim 13 wherein top end of said barrel sidewall has a radius to form a convex curved top edge.

16. A cosmetic dispenser as in claim 13 wherein said easy open closure at the top edge of said barrel sidewall has a radius.

17. A cosmetic dispenser as in claim 13 wherein said weakened region is thinned region.

18. A cosmetic dispenser as in claim 13 wherein said weakened region is a score line.

19. A cosmetic dispenser as in claim 13 wherein said gripping structure is a loop.

* * * * *